United States Patent [19]

Schulzer

[11] 4,390,858

[45] Jun. 28, 1983

[54] LIQUID-COOLED TRANSFORMER FOR LARGE POWER RATINGS

[75] Inventor: Odilo Schulzer, Erlangen, Fed. Rep. of Germany

[73] Assignee: Transformatoren Union Aktiengesellschaft, Stuttgart, Fed. Rep. of Germany

[21] Appl. No.: 247,816

[22] Filed: Mar. 26, 1981

[30] Foreign Application Priority Data

Mar. 31, 1980 [DE] Fed. Rep. of Germany ..... 3012449

[51] Int. Cl.[3] ..... H01F 27/02

[52] U.S. Cl. ..... 336/92; 336/90; 336/92; 336/96; 336/100; 174/15 R

[58] Field of Search ..... 336/90, 92, 96, 100; 174/15 R

[56] References Cited

U.S. PATENT DOCUMENTS 3,098,891 7/1963 Delguste ..... 174/15 R 3,189,858 6/1965 Moore ..... 336/96

*Primary Examiner*—R. L. Moses

*Assistant Examiner*—Susan Steward

*Attorney, Agent, or Firm*—Herbert L. Lerner; Laurence A. Greenberg

[57] ABSTRACT

Liquid-cooled transformer for large power ratings, including a tank having a bottom, large-area base plates resting on the tank bottom, an active part and a pressure device fastened to the base plates, a plurality of synthetic resin-filled cups disposed in the tank bottom, a post supported by and projecting downward from the base plates being immersed in each of the cups for horizontally locking the base plates relative to the tank bottom.

13 Claims, 2 Drawing Figures

LIQUID-COOLED TRANSFORMER FOR LARGE POWER RATINGS

Figure 1:
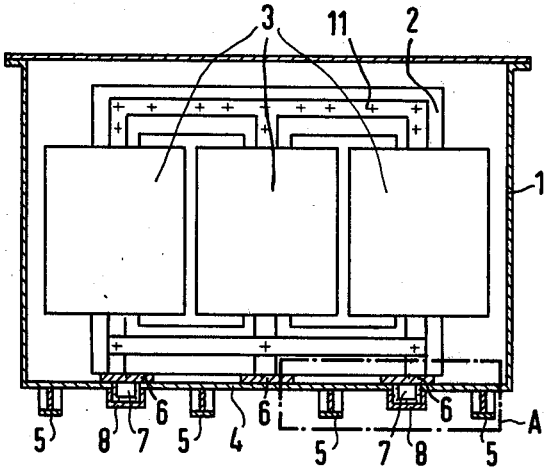

The invention relates to a liquid-cooled transformer for large power ratings with an active part mounted in a tank, wherein the active part with its pressure device is fastened on large-area base plates resting on the bottom of the tank.

The active parts of transformers are held in the tank substantially at the tank bottom in order to prevent relative motion between the active part and the transformer tank. Such relative motion can be caused by excessively large accelerations of the transformer while it is being transported or by earthquakes.

Customarily, two different kinds of mountings have been used heretofore, depending on the expected acceleration forces. Screw connections which are accessible through openings at the bottom of the transformer tank serve for mounting without play. This arrangement, however, has an expensive mechanical construction and, in addition, requires seals.

Another type of mounting used heretofore includes welding stops firmly to the inside of the tank bottom and having corresponding parts of the active part make contact with these stops. The location of the stops, however, depends primarily on the tolerances in tank construction. In addition, the stops must also take up the tolerances which are prescribed in view of maintaining voltage clearances and by the cover cutout for the step switching mechanism. Due to accumulation of these relatively numerous and large tolerances, reworking for relocating these stops is often required. The welding required therefor must then often be performed in manufacturing areas to which particularly strict cleanliness regulations apply and in which, for this reason, the work herein described is extremely undesirable. This subsequent welding is furthermore performed on finished, painted parts, so that repainting is necessary.

It is accordingly an object of the invention to provide a liquid-cooled transformer for large power ratings, which overcomes the hereinafore-mentioned disadvantages of the heretofore-known devices of this general type, and in which an arrangement for locking active parts of transformers in the associated tanks by which a joint which has as little play as possible and can be stressed highly, can be made as simply as possible.

With the foregoing and other objects in view there is provided, in accordance with the invention, a liquid-cooled transformer for large power ratings, comprising a tank having a bottom, large-area base plates resting on the tank bottom, an active part and a pressure device fastened to the base plates, a plurality of synthetic resin-filled cups disposed in the tank bottom, a post supported by and projecting downward from the base plates being immersed in each of the cups for horizontally locking the base plates relative to the tank bottom.

In accordance with another feature of the invention, there are provided stiffening supports disposed on the tank bottom, each of the cups having a rim and being open toward the top and welded to the tank bottom between two of the supports, and the cup rims being flush with the tank bottom.

In accordance with a further feature of the invention, the cups have slightly conical inner surfaces, and the cups are shorter than the supports.

In accordance with an added feature of the invention, there is provided silicone grease brushed on inside the cups between the cups and the synthetic resin, the synthetic resin being settable at room temperature. Therefore the silicone grease is brushed on before the synthetic resin is filled in.

In accordance with an additional feature of the invention, the posts are cylindrical and their diameters are greater than their lengths.

In accordance with again another feature of the invention, the active part has two ends, and at least one post is disposed on each of the ends.

In accordance with again a further feature of the invention, the cups have rims and the synthetic resin fills the cups exactly to the rims about the posts.

In accordance with again an added feature of the invention, the cups and posts define a gap therebetween in which the synthetic resin is disposed, the gaps being substantially 2 cm thick in the radial direction on the average.

In accordance with again an additional feature of the invention, there are provided heating baths attachable to the periphery of the cups below the tank bottom for accelerating setting of the synthetic resin.

In accordance with a concomitant feature of the invention, there is provided a detachable transverse bolt being insertable through at least one of the cups and posts parallel to the tank bottom after the synthetic resin has set for oil-tightly closing the at least one cup.

The locking arrangement according to the invention is very advantageous because it effectively produces, without reworking, a connection without play between the active part and the tank of a large transformer, exclusively using materials already proven in the construction of transformers. Apart from the problem-free disassembly of the active part from the tank, the arrangement according to the invention also allows an improvement of the arrangement for taking up vertical forces in a very simple manner. Other features which are considered as characteristic for the invention are set forth in the appended claims.

Although the invention is illustrated and described herein as embodied in a liquid-cooled transformer for large power ratings, it is nevertheless not intended to be limited to the details shown, since various modifications and structural changes may be made therein without departing from the spirit of the invention and within the scope and range of equivalents of the claims.

Figure 2:
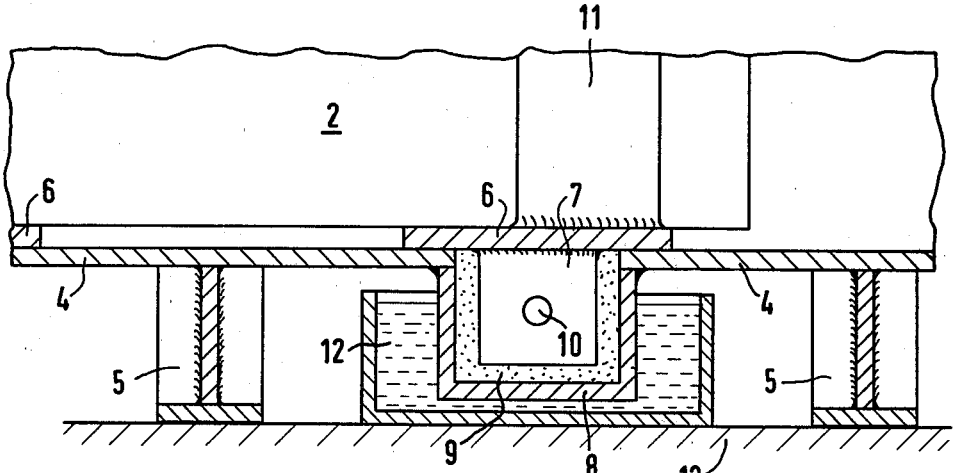

The construction and method of operation of the invention, however, together with additional objects and advantages thereof will be best understood from the following description of specific embodiments when read in connection with the accompanying drawings, in which:

FIG. 1 is a diagrammatic partly cross-sectional view of the basic construction of a large transformer; and FIG. 2 is a fragmentary enlarged view of the dot-dash rectangle A of FIG. 1.

Referring now particularly to FIGS. 1 and 2 of the drawing as a whole, it is seen that a core 2 and windings 3 form the active part of a transformer and are mounted in an oil-filled tank 1. The core 2 is supported on the tank bottom 4 by base plates 6. The tank bottom 4 is provided with support beams or bearers for stiffening. A pressure device 11 is also fastened to the base plates 6.

Posts 7 are fastened under the base plates 6 at the ends of the core 2, preferably by welding. The posts 7 project at these points into cups 8 welded under the tank bottom 4. The location of the supports 5 and the disposition of the base plates 6 that are provided with the posts 7 are mutually matched in such a manner that the cups 8 receiving the posts 7 are always approximately centrally situated between two supports 5. The cups 8 project downward a lesser distance than the supports 5, so that the cups remain unloaded if the tank 1 is set down on a flat support surface or floor 13.

Before the active part made up of the core 2 and windings 3 is inserted into the tank 1, the cups 8 are filled with a viscous synthetic resin, which can be worked for an hour and allowed to set at room temperature. This is done to the extent that the cups 8 are filled with synthetic resin 9 exactly to the rim after the posts 7 have entered. The gap between the side walls of the cups 8 and the associated posts 7 filled with this synthetic resin 9 serves for equalizing tolerances between the active part of the transformer and the tank bottom 4, and is about 2 cm thick on the average. A circular cross section is advantageous for the shape of the posts; the diameter of the post 7 should be larger than its length.

To facilitate disassembly from the tank 1, which may become necessary, the cups 8 are made slightly conical and are brushed with silicone grease before the synthetic resin is filled in. In this way blocks of synthetic resin 9 which have already set when the active part is lifted out, are pulled out of the cups 8 without difficulty and are then freely accessible, so that they can then be removed from the posts 7 without special difficulty. During the subsequent reinsertion of the active part, the cups 8 are then refilled with fresh, still workable synthetic resin in the manner described above.

Under particularly unfavorable loading conditions, when vertical forces lifting the active part from the tank bottom 4 occur, transverse bolts 10 which are inserted through prepared holes in the side walls of the cups 8 and the corresponding posts 7 parallel to the tank bottom 4 are installed, after the synthetic resin has set. The holes in the side walls of the cups 8 are closed oil-tight by means of transverse bolts 10. The transverse bolts 10 are detachably fastened, so that even with this arrangement, the active part can be lifted out of the tank 1 after the transverse bolts 10 are removed.

Heating baths 12 are attached to the periphery of the cups 8 below the tank bottom 4 to accelerate the setting of the resin 9.

There is claimed:

1. Liquid-cooled transformer for large power ratings, comprising tank having a bottom, large-area base plates resting on said tank bottom, an active part and a pressure device fastened to said base plates, a plurality of separate cups disposed in said tank bottom, hardenable liquid synthetic resin filling said cups, a plurality of posts being supported by and projecting downward from said base plates in direction of said tank bottom, each of said posts being immersed in a respective one of said separate cups for horizontally locking said active part relative to said tank bottom.

2. Liquid-cooled transformer according to claim 1, including stiffening supports disposed on said tank bottom, each of said cups having a rim and being open toward the top and welded to said tank bottom between two of said supports, and said cup rims being flush with said tank bottom.

3. Liquid-cooled transformer according to claim 2, wherein said cups have slightly conical inner surfaces, and said cups are shorter than said supports.

4. Liquid-cooled transformer according to claim 1, including silicone grease brushed on inside said cups between said cups and said synthetic resin, said synthetic resin being settable at room temperature.

5. Liquid-cooled transformer according to claim 1, wherein said posts are cylindrical and their diameters are greater than their lengths.

6. Liquid-cooled transformer according to claim 1, wherein said active part has two ends, and at least one post is disposed on each of said ends.

7. Liquid-cooled transformer according to claim 1, wherein said cups have rims and said synthetic resin fills said cups to said rims about said posts.

8. Liquid-cooled transformer according to claim 1, wherein said cups and posts define a gap therebetween in which said synthetic resin is disposed, said gaps being substantially 2 cm thick in the radial direction on the average.

9. Liquid-cooled transformer according to claim 1, including heating baths attachable to the periphery of said cups below said tank bottom for accelerating setting of said synthetic resin.

10. Liquid-cooled transformer according to claim 1, including a detachable transverse bolt being insertable through at least one of said cups and posts parallel to said tank bottom after said synthetic resin has set for oil-tightly closing said at least one cup.

11. Liquid-cooled transformer according to claim 1, including means disposed outside said cups for heating said cups and accellerating setting of said synthetic resin.

12. Method for horizontally locking in place the active part of a large power-rated liquid-cooled transformer, including a tank having a bottom, large area base plates resting on the tank bottom, a pressure device being fastened to the base plates along with the active part, and a plurality of separate cups disposed in the tank bottom, which comprises extending a plurality of posts downwardly from the base plates in direction of said tank bottom, immersing at least part of each of the posts in a respective one of the separate cups, and filling the cups with hardenable liquid synthetic resin for horizontally locking the active part.

13. Method according to claim 12, which comprises heating the cups from outside the cups for accellerating setting of the synthetic resin.

* * * * *